US006196291B1

(12) United States Patent
Rupel et al.

(10) Patent No.: US 6,196,291 B1
(45) Date of Patent: Mar. 6, 2001

(54) LIGHT CONTROL WINDOW COVERING AND METHOD OF MAKING SAME

(76) Inventors: John D. Rupel, 3565 S. Point Rd., Verona, WI (US) 53593; Ren Judkins, 46 Newgate Rd., Pittsburgh, PA (US) 15202

( * ) Notice: Subject to any disclaimer, the term of this patent is extended or adjusted under 35 U.S.C. 154(b) by 0 days.

(21) Appl. No.: 08/979,438

(22) Filed: Nov. 26, 1997

(51) Int. Cl.[7] ..... A47H 5/00
(52) U.S. Cl. ..... 160/84.05
(58) Field of Search ..... 160/84.05, 84.04, 160/84.01, 84.06, 89, 121.1

(56) References Cited

U.S. PATENT DOCUMENTS

| | | | | |
|---|---|---|---|---|
| 3,384,519 | | 5/1968 | Froget | 156/65 |
| 4,625,796 | * | 12/1986 | Carter et al. | 160/84.06 |
| 5,176,192 | * | 1/1993 | Judkins et al. | 160/84.04 |
| 5,205,333 | | 4/1993 | Judkins | 160/84.1 |
| 5,313,999 | | 5/1994 | Colson et al. | 160/121.1 |
| 5,339,882 | | 8/1994 | Judkins | 160/84.1 |
| 5,490,553 | * | 2/1996 | Colson et al. | 160/89 X |
| 5,664,613 | * | 9/1997 | Jelic | 160/121.1 X |
| 5,701,940 | * | 12/1997 | Ford et al. | 160/84.05 |
| 5,837,084 | * | 11/1998 | Barss | 160/84.05 X |

* cited by examiner

*Primary Examiner*—David M. Purol
(74) *Attorney, Agent, or Firm*—Buchanan Ingersoll, P.C.

(57) ABSTRACT

A cellular structure for window coverings has a plurality of cells formed by an upper vane and a lower vane each having a front edge and a rear edge. A C-shaped front wall has an upper end attached to the front edge of the upper vane and a lower end attached to the front edge of the lower vane to form an outwardly extending front tab at each end of the C-shaped front wall. The opposite end of each vane is attached to a rear wall. A C-shaped rear wall could be used for each cell. This structure is made by placing an edge of the vane between a pleat which is bonded to form each front tab and then preferably trimming the tab to a uniform width.

34 Claims, 5 Drawing Sheets

LIGHT CONTROL WINDOW COVERING AND METHOD OF MAKING SAME

FIELD OF THE INVENTION

The invention relates to window coverings and particularly to a light control window covering having strips or slats that can be tilted from an open position to a closed position to control the amount of light which is admitted.

BACKGROUND OF THE INVENTION

Venetian blinds are well-known window coverings. They have a series of horizontal slats hung from ladders which extend between a headrail and a bottom rail. The slats can be rotated between an open, see through position and a closed position. Additionally, the blinds can be raised and lowered. Venetian blinds contain aluminum, plastic or wood slats and are available in a limited number of colors.

Draperies are another common window covering. Draperies are available in a variety of materials and colors. Commonly a designer will provide a sheer curtain which permits some passage of light in combination with a heavier drapery through which light cannot pass. Consequently, the owner of that drapery system may have a completely open window, a window covered by the sheer which allows for daytime privacy, some passage of light and a view of the outside; or a window covered by the heavier drapery and a sheer which allows night time privacy, little passage of light, and no view of the outside.

In U.S. Pat. Nos. 3,384,519 to Froget and 5,313,999 to Colson et al. there are disclosed cellular type window coverings having first and second parallel sheer fabric sheets hung from a roller. A plurality of light impeding or somewhat light impeding vanes extend between the sheer fabric sheets. The vanes are angularly controllable by relative movement of the fabric sheets. Like the combination of a sheer fabric and a light impeding fabric, these system allow the user to have a fully open window, a sheer covered window allowing light transmission with daytime privacy, and a covering providing night time privacy or room darkening. In addition, such systems have intermediate light control of a louvered product like venetian blinds. Both the Froget and Colson window covering systems are difficult to fabricate, have a very flat appearance when in the closed, light impeding position, can only be tilted in one direction and can only be tilted when completely deployed. They also have a very limited selection of fabrics because three layers of fabric must wrap around a tube with the back layer traveling much farther than the front layer.

Judkins in U.S. Pat. No. 5,339,882, discloses a window covering having a series of slats connected to two spaced apart sheets of material. In one embodiment, the slats are attached to tabs extending inward from each sheet. The slats are substantially perpendicular to the sheets of material when the covering is in an open position. The slats are substantially parallel to the first and second sheets of material when the window covering is in a closed position. This product does not roll up readily and is intended to be raised with lift cords.

In U.S. Pat. No. 5,205,333, Judkins discloses a cellular shade formed by attaching an accordion pleated shade to a tabbed sheet. In this shade the tabs extend outwardly.

Pleated cellular window coverings have a spring take-up in the pleat. It is desirable that the cellular structure have a fullness in the pleat and that the face of the structure not go flat. The front face need not be equally spaced from the back face across each cell, nor must the front cell wall have the same height as the back cell wall. Indeed, it is sometimes desirable to have a shorter back wall to keep fullness in the front. Any side to side variances are hidden by the fullness of the pleat. However, in a window covering of the type disclosed by Colson in U.S. Pat. No. 5,313,999 the opposite is true. It is important that the fabric faces be nearly flat and the vanes be equally spaced from side to side and front to back. Since light passes through the cells, variances in cells are readily apparent and detract from the closure.

Most woven and knitted fabrics are not uniform. They go askew, have a bias or have a belly in the middle or sides. This lack of consistency is particularly common in the very soft, light body, sheer fabrics that are most desirable for this type of product. If a cellular structure is formed from most woven and knitted fabrics using conventional bonding practices, the excess material tends to bulge or form a bag. This bagging causes the cells to be non-uniform. Yet, non-uniform cells are undesirable in a light control product. Consequently, there is a need for a method of forming light control window coverings with uniformly sized cells. Such a process must compensate for the irregularities found in most woven and knitted fabrics.

Lift cords are required in those cellular products which are not attached to a roller. Because some customers find lift cords detract from the appearance of the shade, most fabric light control window coverings are being offered on rollers. Yet, lift cords allow tilt in both directions, tilt in intermediate positions, and bottom and top stacking shades. Lift cords even allow non-rectangular shades to tilt. Consequently, there is a need in the marketplace for cellular products and particularly light control cellular products having lift cords which are not noticeable. There is also a need for a light control window covering having two sheets of sheer fabric connected by light impeding vanes which is controllable by lift cords and which can be tilted in either direction even when the product is partially stacked. Additionally, there is a need for light control window coverings that can be made as arches, slant tops, and other non-rectangular shapes and can be used in a wide variety of specialty applications.

SUMMARY OF THE INVENTION

We provide a light controllable window covering in which there is an outwardly or inwardly tabbed front sheet and a back sheet which preferably is also tabbed outwardly or inwardly. As the outwardly facing tabs are formed one edge of a vane is inserted between the segments of the sheet that form each tab. The tabs are bonded in a manner to assure uniform length of the material between tabs to maintain uniform cell size. Frequently, maintaining uniform cell size for light transmissive fabric creates a tab having a curved outer edge. This is usually not noticeable because the tab is perpendicular to the viewer. However, we prefer to trim the tab as it is bonded to create a uniform width in the tab, especially for tabs formed in the front sheet. If desired, the outwardly facing tabs could be trimmed off entirely or trimmed to be only a few thousandths of an inch in width.

We further prefer to provide a striated fabric for the back sheet and optionally the front sheet of the window covering. This fabric has vertically oriented striate yarns having a diameter close to the diameter of the lift cords. As a result the lift cords are hidden.

Other objects and advantages of the present invention will become apparent from the description of certain preferred embodiments shown in the drawings.

DESCRIPTION OF THE PREFERRED EMBODIMENTS

Figure 1:
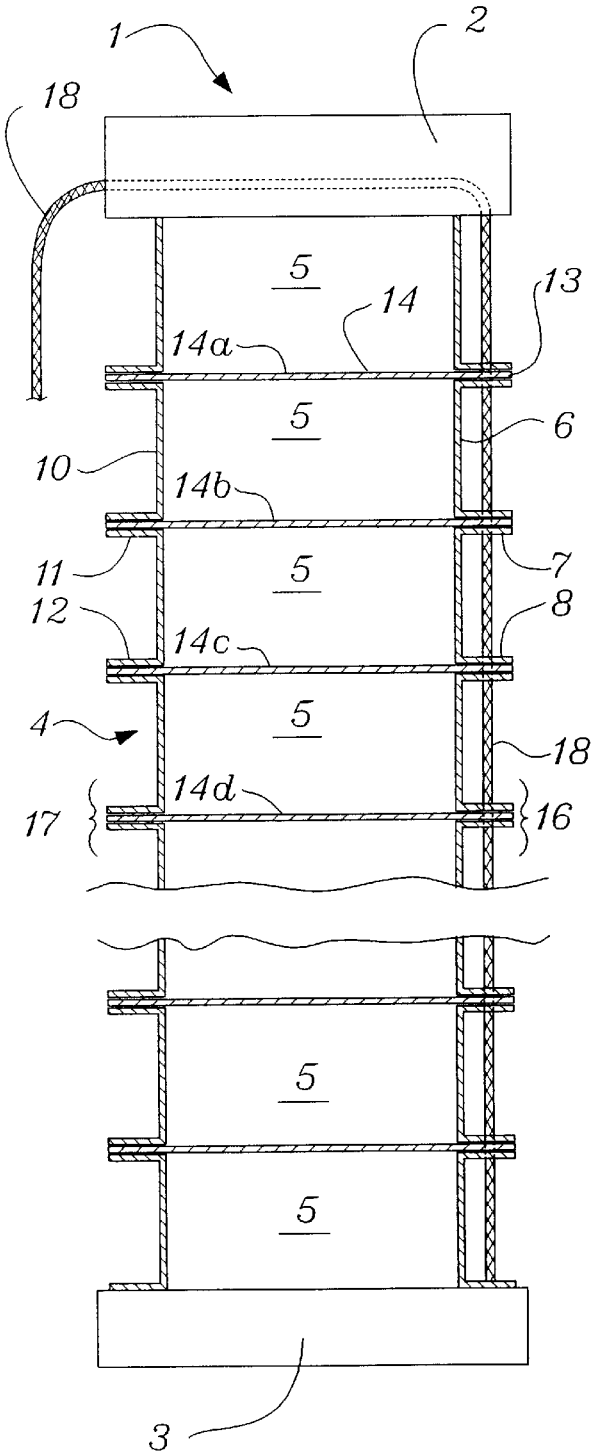
FIG. 1 is a side view of a present preferred embodiment of our window covering.
Figure 2:
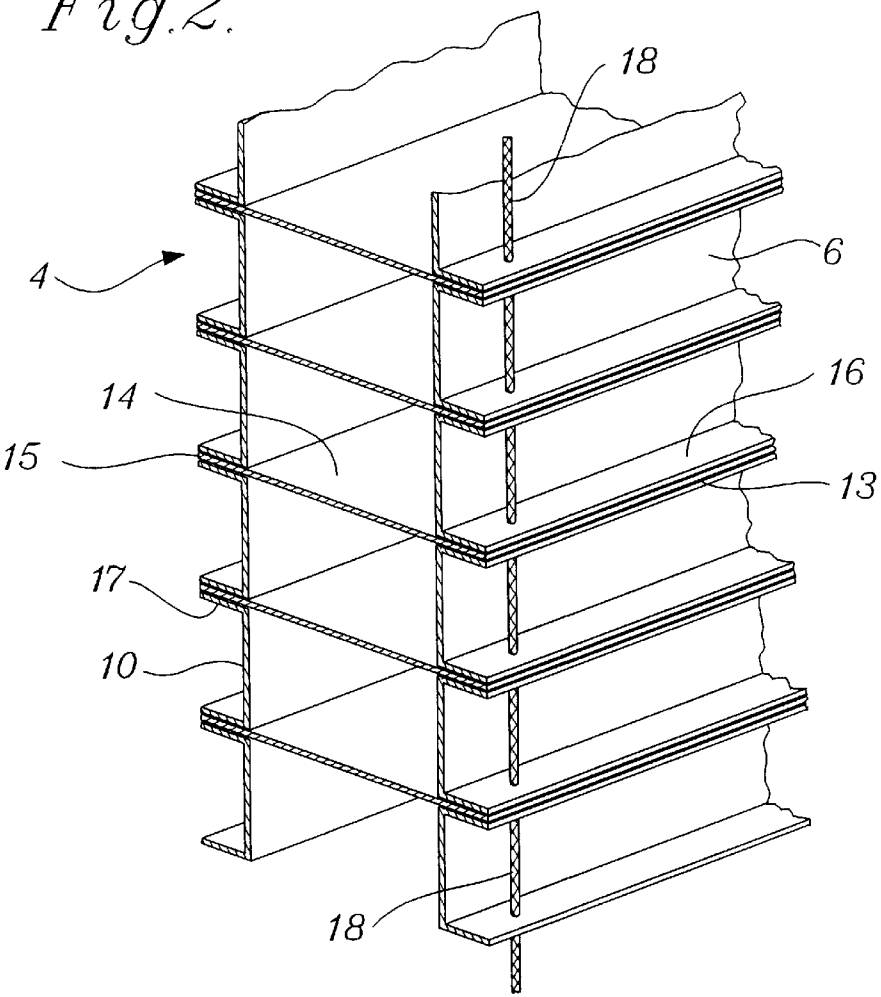
FIG. 2 is a perspective view of a portion of the cellular structure in the window covering of FIG. 1.

A first present preferred embodiment of our window covering is illustrated in FIGS. 1 and 2. This window covering 1 has a headrail 2, bottom rail 3 and cellular structure 4 connected therebetween. The cellular structure has a series of cells 5. Each cell is formed by an outwardly facing front C-shaped wall 6 and an outwardly facing rear C-shaped wall 10 connected to vanes 14. As can be seen from FIG. 1 each vane forms one wall of the cells above and below that vane. For example, the second cell from the top is formed by a rear C-shaped wall 6, a front C-shaped wall 10 and vanes 14*a* and 14*b*. The third cell is formed by a rear C-shaped wall, a front C-shaped wall and vanes 14*b* and 14*c*. Each vane 14 has a rear transverse edge 13 that is connected to the upper end 7 of the rear C-shaped wall below the vane and to the lower end 8 of the rear C-shaped wall above the vane. Similarly, the front transverse edge 15 of each vane 14 is connected to the upper end of the front C-shaped wall below the vane and to the lower end 12 of the front C-shaped wall above the vane. These attachments form rear tab 16 and front tab 17. Lift cords 18 extend from the bottom rail 3 through holes in tabs 16 and through the headrail 18. Although only one lift cord is shown in the figures it should be understood that typically two or more lift cords will be provided depending upon the width of the window covering. Lift cords also could run through the front tabs 17 or be within the cells and pass through the vanes as in the embodiment shown in FIG. 3.

Figure 3:
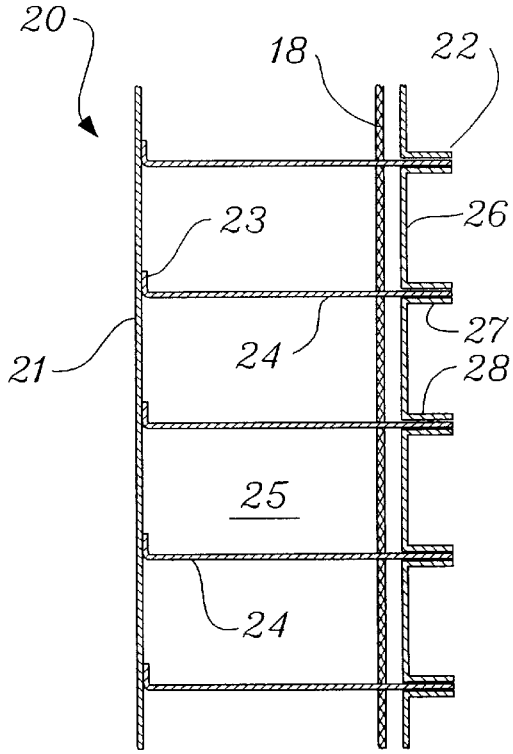
FIG. 3 is a side view of a second preferred cellular structure.

The second preferred embodiment shown in FIG. 3 is a cellular structure 20 in which vanes 24 are attached to front sheet 21 in a conventional manner. Typically this would be done by gluing or ultrasonic welding. The rear portion of the cellular structure is the same as in the first embodiment. There is a C-shaped wall 26 having an upper end 27 connected to the vane above it and a lower end 28 connected to the vane below it.

We prefer that the C-shaped walls 6 and 10 in the first embodiment as well as the front sheet 21 and the C-shaped walls 26 in the second embodiment be made of a light transmissive material, preferably a sheer fabric. The fabric may be woven, knit, film or nonwoven. The vanes 14 and 24 can be made from any light impeding fabric. Consequently, when the cellular structure is positioned as shown in FIGS. 1, 2 and 3 light can pass through the cellular structure. By moving the rear C-shaped portions relative to the front sheet or front C-shaped portions, one can tilt the vanes 14 and 24 at any desired angle until a closed position is achieved substantially preventing passage of the light through the cellular structure.

Figure 4:
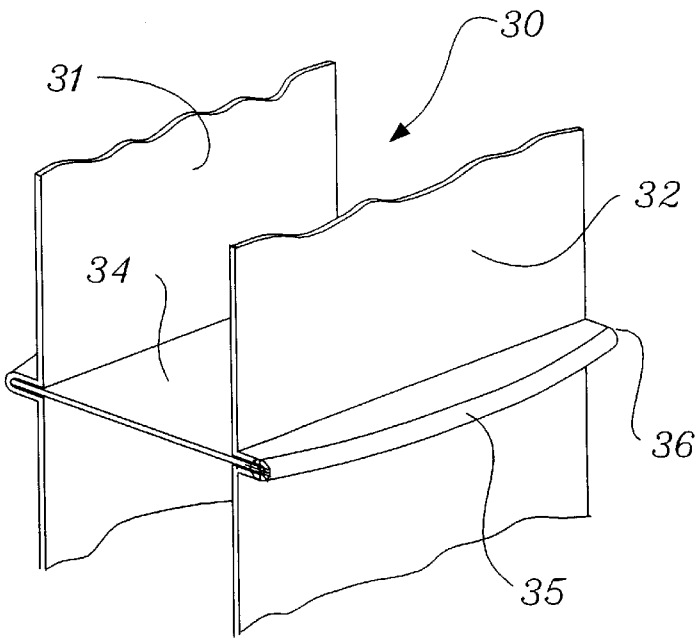
FIG. 4 is a side view of a portion of a cellular structure made in accordance with this invention.
Figure 5:
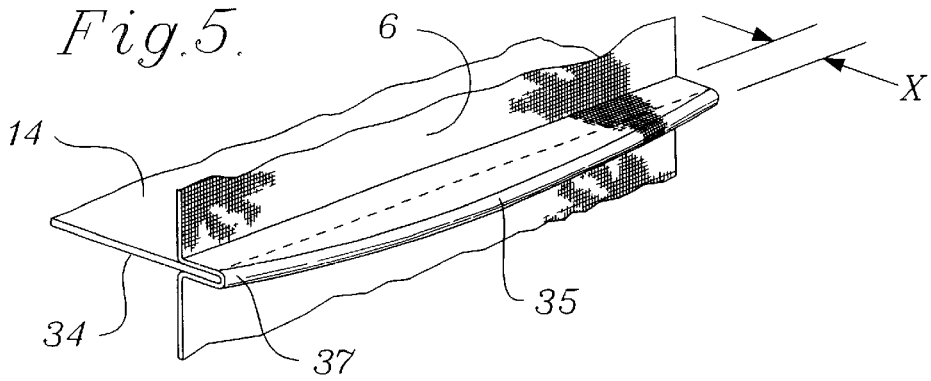
FIG. 5 is perspective view of the tab of the cellular structure of FIG. 4.

Referring to FIGS. 4 and 5, we have found that when a sheer fabric material 31 and 32 is bonded to a vane 34 to form a cellular structure 30 there will often be more material toward the center of the cellular structure than the edges. To maintain the same height for all cells, it is necessary to draw this additional material into the tab forming a bowed portion 35 at the center of the tab. As a consequence, tab 36 will have a non-uniform depth. Depending on the variation and whether the tab is on the front or the back, tabs with non-uniform depths are less attractive than tabs of uniform depth throughout the length. The alternative cellular structure having a non-uniform cell sizes, is less attractive and usually does not tilt as well as those which are of uniform cell size. In order to achieve uniform cell size for sheer fabric cellular structures and tabs of uniform depth, we create a tab such as shown in FIGS. 4 and 5. To improve the appearance of the product we prefer to trim the tab along the dotted line in FIG. 5 so that the tab has a width "x" which is uniform throughout the length of the tab.

Figure 6:
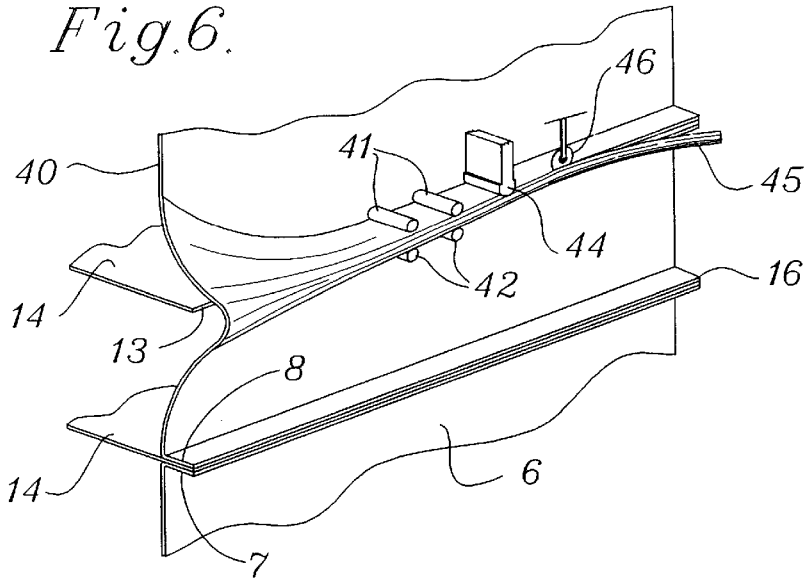
FIG. 6 is a perspective view illustrating a first preferred method for making our cellular structure

One present preferred method for forming the cellular structure having uniform cell size and tabs of constant width is shown in FIG. 6. There we provide a sheet of fabric 40. Upper pinch rollers 41 and lower pinch rollers 42 are passed across the width of the fabric to form a tab structure 36 and assure that the cells are uniform. Ultrasonic weld head 44 welds the top portion and bottom portion of the tab to the longitudinal edge 13 of vane 14 as it is being inserted into the tab. Cutter 46 trims away a sufficient amount of material so that a tab 16 of constant width is formed. The material 45 that has been trimmed away is discarded. The width of the discarded material usually is from 0.010 to 0.150 inches. The result of the process forms a tab 16 such as is shown in FIGS. 1 and 2. There is created an outwardly facing C-shaped wall 6 having an upper end 7 connected to the underside of the longitudinal edge 13 of vane 14. The lower end 8 of the C-shaped wall that is formed is attached to the upper surface of the longitudinal edge of vane 14.

Figure 7:
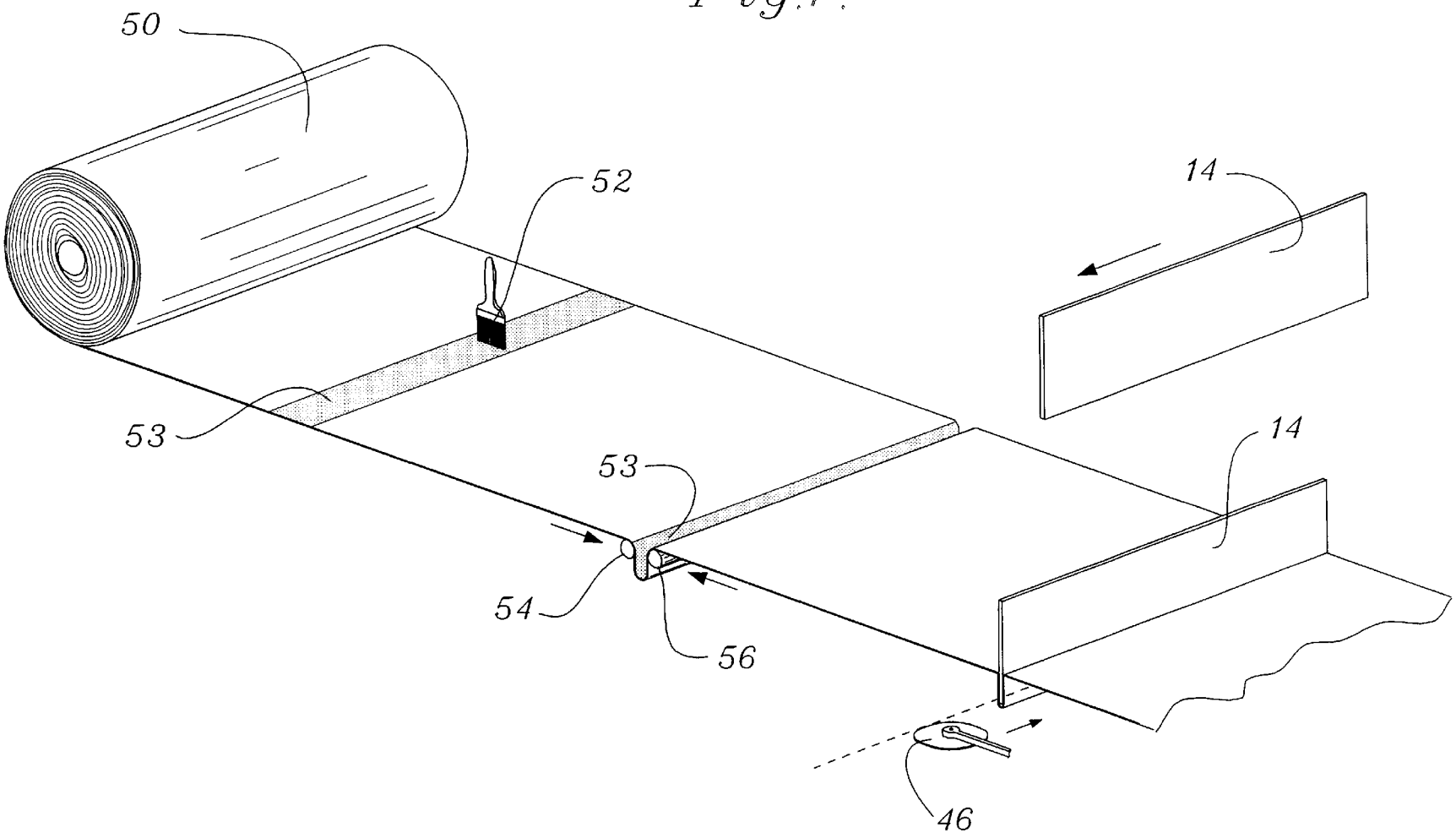
FIG. 7 is a diagram showing a second present preferred method of manufacturing our cellular structure.

Another method of forming this cellular structure is shown in FIG. 7. As the fabric 50 is unrolled, a glue head 52 applies an adhesive, preferably a thermoplastic adhesive, to one surface of the material. Then, pinch rollers 54 and 56 form a pleat in the fabric as vane 14 is inserted within the pleat. Consequently, the adhesive bonds the longitudinal edge of vane 14 to the fabric 50 forming a tab. A cutter 46 trims the tab to have a uniform width across its length.

Figure 8:
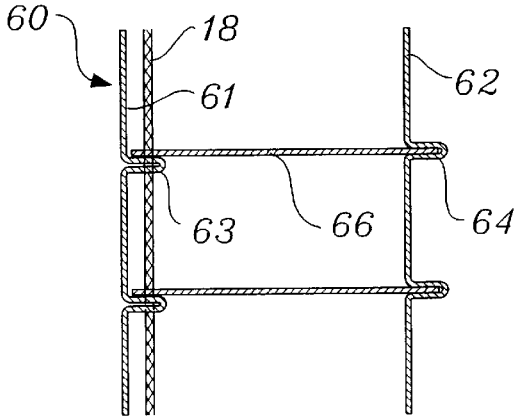
FIG. 8 is a side view of a third present preferred cellular structure.
Figure 9:
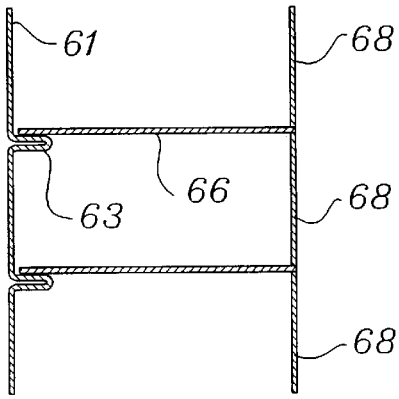
FIG. 9 is a side view of a fourth present preferred cellular structure.

In the embodiment 60 shown in FIG. 8 we provide a rear sheet 61 with inwardly extending tabs 63 and a front sheet 62 having outwardly extending tabs 64. Vanes 66 are attached between the front sheet 62 and rear sheet 61. The rear edge of each vane can be attached to the top of the rear tab 63 as shown or to the underside of the rear tab which is not shown. The front edge of each vane is inserted within a front tab 64 as is done in the previous embodiments. The lift cords 18 are threaded through the inwardly facing tabs 63 but alternatively could pass through the outwardly extending tabs 64. Outwardly extending tabs 64 can be partially cut as already described, or completely cut away to create the structure shown in FIG. 9. In that embodiment the front edge of each vane is flush with or nearly flush with and separates two front walls 68 of adjacent cells. The tabs 64 can be trimmed immediately after being formed preferably using the method shown in FIG. 6 or FIG. 7. Preferably the remaining portion of the tab does not exceed 0.005 inches.

Tabs contribute to the three dimensional character if the fabric. Inwardly facing tabs give the shade a thickness when closed. Outwardly facing tabs add a surface to the face of the product. The appearance of the tab may be varied by changing the size of the tab. Tabs with cords passing through them would be relatively large. Tabs cut completely or almost completely off would render a flat appearance which is preferred with certain fabrics.

Figure 10:
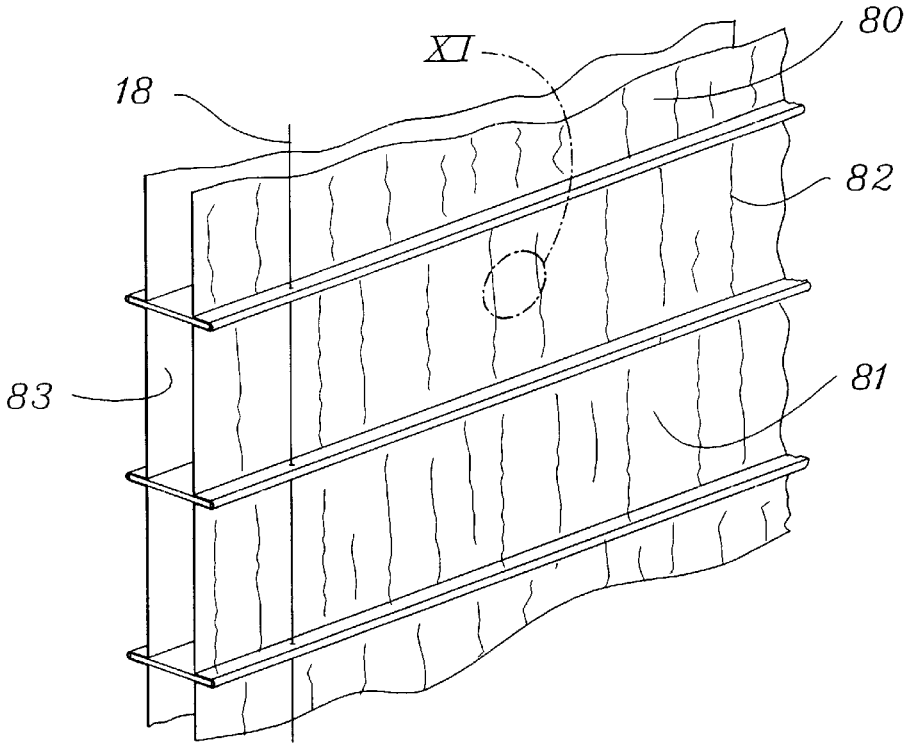
FIG. 10 is a perspective view of a fifth present preferred cellular structure.
Figure 11:
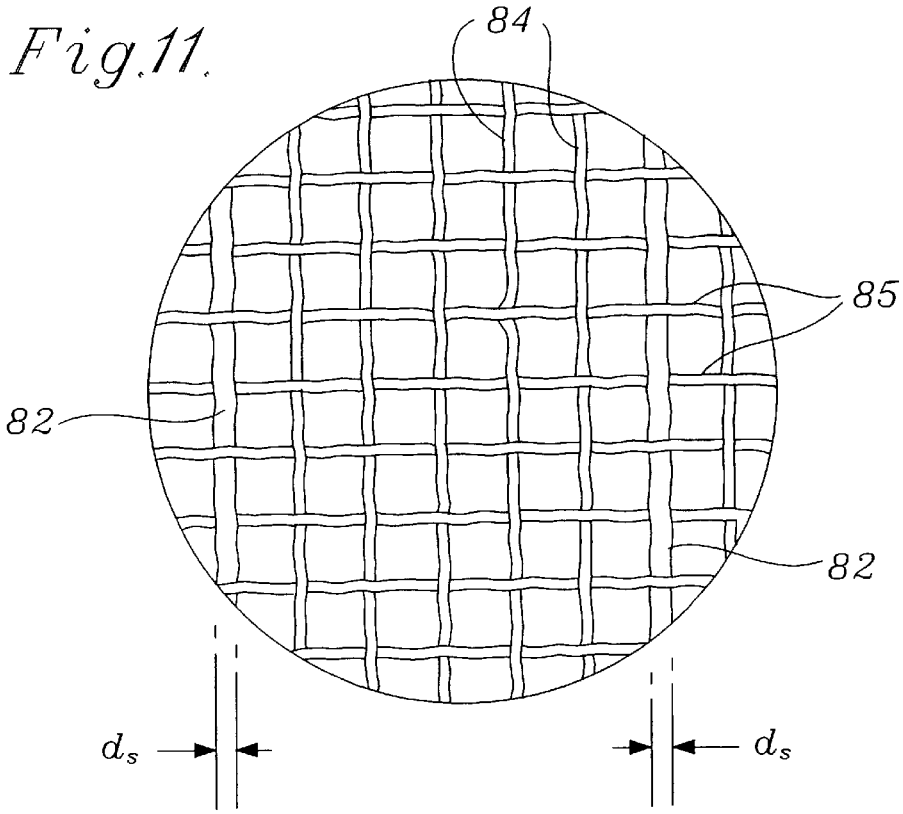
FIG. 11 is an enlarged view of the fabric taken on the dotted circle XI of FIG. 10.

We prefer to provide cellular structures such as shown in FIG. 10 in which a striated fabric 80 is used for either the front portion 81 or the rear portion 83 of the cellular structure. In the striated fabric shown in enlarged version in FIG. 11 there are vertical threads 84 and horizontal threads 85 woven together. At spaced apart intervals there are relatively wide striate yarn segments 82. We prefer that the striate yarn segments be oriented vertically as shown in FIG. 10. Thus, the striate yarn fabrics will be parallel or substantially parallel to the lift cord 18. The striate yarn segments are selected to have a diameter $d_s$ perceptively different from the surrounding yarns and approximately the same as the diameter of the lift cord 18. To avoid having the lift cords easily seen, the diameter of the lift cords should not exceed twice the diameter of the striate yarns. Typically, the lift cord will be a very thin cord or a monofilament line having a diameter of about 0.020 inches or at least twice the diameter of the majority of vertical threads 84 from which the fabric is woven. When the cellular structure such as shown in FIG. 10 is placed in the window, the lift cord 18 appears to be a striated yarn within the fabric. Thus, the lift cord is disguised to be part of the fabric from which the cellular structure is made.

In describing the preferred embodiments we have identified a front and rear of each structure. These terms were used for ease of understanding and are not intended to limit the claimed invention. What we have called the front could be the rear and what is identified as the rear could be the front.

Although we have shown certain present preferred embodiments of our window covering cellular structure and methods of making the same, it should be distinctly understood that our invention is not limited thereto, but may be variously embodied within the scope of the following claims.

We claim:

1. A single cell cellular structure comprised of a plurality of cells each cell comprised of:

a. an upper vane having a front edge and a rear edge;

b. a lower vane having a front edge and a rear edge;

c. a rear wall to which the rear edges of the upper vane and the lower vane are attached; and d. a C-shaped front wall having an upper end attached to the front edge of the upper vane and a lower end attached to the front edge of the lower vane, wherein an outwardly facing tab is formed by the front edge of each vane, the upper end of one C-shaped front wall and the lower end of an adjacent C-shaped front wall.

2. The cellular structure of claim 1 wherein the rear wall is C-shaped having an upper end attached to the rear edge of the upper vane and a lower end attached to the rear edge of the lower vane forming a rear tab.

3. The cellular structure of claim 2 wherein an outwardly facing rear tab is formed by the rear edge of each vane, the upper end of one C-shaped rear wall and the lower end of an adjacent C-shaped rear wall.

4. The cellular structure of claim 2, also comprising at least two lift cords through one of each tab, each rear tab and each vane.

5. The cellular structure of claim 4 wherein the at least two lift cords have a lift cord diameter and wherein at least one of the front wall and the rear wall are a striated fabric having striate yarns which have a striate yarn diameter such that the lift cord diameter and the striate yarn diameter are not perceptibly different.

6. The cellular structure of claim 1 wherein the front wall and the rear wall are a light transmissive material.

7. The cellular structure of claim 1 also comprising at least two lift cords through one of each tab and each vane.

8. The cellular structure of claim 7 wherein the at least two lift cords have a lift cord diameter and wherein at least one of the front wall and the rear wall are a striated fabric having striate yarns which have a striate yarn diameter such that the lift cord diameter and the striate yarn diameter are not perceptibly different.

9. The cellular structure of claim 7 wherein at least one of the front wall and the rear wall are a striated fabric having striate yarns which are substantially parallel to at least one of the at least two lift cords.

10. The cellular structure of claim 9 wherein the striated fabric contains striate yarn having a diameter and also comprising at least one cord passing through the cells, the at least one cord having a diameter not greater than twice the diameter of the striate yarn.

11. The cellular structure of claim 1 wherein each outwardly facing tab has been trimmed so as to not exceed 0.005 inches.

12. A cellular structure comprised of:

a. a front surface and a substantially parallel rear surface, at least one of the front surface and the rear surface being a striated fabric containing striate yarn having a diameter;

b. a plurality of vanes connected between the front surface and the rear surface in a manner to form cells; and c. at least one cord passing through the cells, the at least one cord having a diameter not greater than twice the diameter of the striate yarn.

13. The cellular structure of claim 12 wherein the at least one cord is parallel to at least a portion of the striate yarn.

14. An improved window covering of the type having a cellular material having a plurality of cells with lift cords passing through the cells and extending from a headrail wherein the improvement is comprised of a cellular structure in which a plurality of the cells forming the cellular structure is comprised of:

a. an upper vane having a front edge and a rear edge;

b. a lower vane having a front edge and a rear edge;

c. a rear wall to which the rear edges of the upper vane and the lower vane are attached; and d. a C-shaped front wall having an upper end attached to the front edge of the upper vane and a lower end attached to the front edge of the lower vane;

wherein an outwardly facing tab is formed by the front edge of each vane, the upper end of one C-shaped front wall and the lower end of an adjacent C-shaped front wall.

15. The improved window covering of claim 14 wherein the rear wall is C-shaped having an upper end attached to the rear edge of the upper vane and a lower end attached to the rear edge of the lower vane.

16. The improved window covering of claim 15 wherein an outwardly facing rear tab is formed by the rear edge of each vane, the upper end of one C-shaped rear wall and the lower end of an adjacent C-shaped rear wall.

17. The improved window covering of claim 14 wherein the front wall and the rear wall are a light transmissive material.

18. The improved window covering of claim 14 wherein the at least two lift cords have a lift cord diameter and wherein at least one of the front wall and the rear wall are a striated fabric having striate yarns which have a striate yarn diameter such that the lift cord diameter and the striate yarn diameter are not perceptibly different.

19. The improved window covering of claim 14 wherein the plurality of lift cords pass through one of each tab and each vane.

20. The improved window covering of claim 14 wherein the plurality of lift cords have a lift cord diameter and wherein at least one of the front wall and the rear wall are a striated fabric having striate yarns which have a striate yarn diameter such that the lift cord diameter and the striate yarn diameter are not perceptibly different.

21. The improved window covering of claim 14 wherein at least one of the front wall and the rear wall are a striated fabric having striate yarns which are substantially parallel to at least one of the plurality of lift cords.

22. The improved window covering of claim 21 wherein the striated fabric contains striate yarn having a diameter and the plurality of lift cords each have a diameter not greater than twice the diameter of the striate yarn.

23. The improved window covering of claim 14 wherein each outwardly facing tab has been trimmed so as to not exceed 0.005 inches.

24. The improved window covering of claim 14 wherein at least one of the front wall and the rear wall are a striated fabric.

25. The improved window covering of claim 24 wherein the striated fabric contains striate yarn having a diameter and also comprising at least one cord passing through the cells and into the headrail, the at least one cord having a diameter not greater than twice the diameter of the striate yarn.

26. An improved window covering of the type having a cellular material extending from a headrail wherein the improvement is comprised of a cellular structure forming the cellular material which cellular structure is comprised of:

a. a front surface and a substantially parallel rear surface, at least one of the front surface and the rear surface being a striated fabric containing striate yarns having a diameter;

b. a plurality of vanes connected between the front surface and the rear surface in a manner to form cells; and c. at least one cord passing through the cells and into the headrail.

27. The improved window covering of claim 26 wherein the at least one cord has a diameter not greater than twice the diameter of the striate yarns.

28. The improved window covering of claim 26 wherein the at least one cord is substantially parallel to at least a portion of at least some of the striate yarns.

29. A cellular shade structure comprising:

a. a front surface; and b. a rear surface, at least one of said front and rear surfaces including a plurality of tabs extending outwardly from said at least one of said front and rear surfaces, each of said tabs comprising an upper layer of material, an intermediate layer of material and a lower layer of material.

30. A cellular shade structure in accordance with claim 29, in which the intermediate layers of said tabs comprise the outer portions of vanes connecting said front and rear surfaces.

31. A cellular shade structure in accordance with claim 29, in which the lower layer of one of said tabs, the upper layer of the lower adjacent one of said tabs, and the intermediate portion of said outer surface comprise a continuous segment of material.

32. A cellular shade structure in accordance with claim 29, in which said layers are joined to each other by ultrasonic welding.

33. A cellular shade structure in accordance with claim 29, in which said layers are joined to each other by adhesive material.

34. A cellular shade structure in accordance with claim 29, wherein said top layer and said bottom layer are formed from a continuous piece of material which is wrapped around the intermediate layer and trimmed to separate the top layer from the bottom layer.

* * * * *